US006394090B1

(12) United States Patent
Chen et al.

(10) Patent No.: US 6,394,090 B1
(45) Date of Patent: May 28, 2002

(54) FLAT-FOLDED PERSONAL RESPIRATORY PROTECTION DEVICES AND PROCESSES FOR PREPARING SAME

(75) Inventors: Daniel T. Chen, St. Paul; Dana W. Nouri, Minneapolis, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/250,825

(22) Filed: Feb. 17, 1999

(51) Int. Cl.[7] ..... A62B 7/10; A62B 18/08; A62B 23/02

(52) U.S. Cl. ..... 128/206.12; 128/205.27; 128/205.29; 128/206.13; 128/206.16; 128/206.17; 128/206.19; 128/206.21; 128/206.24; 128/206.28; 128/207.11

(58) Field of Search ..... 128/705.27, 705.29, 128/206.12, 206.13, 206.16, 206.17, 206.29, 206.21, 206.24, 206.27, 206.28, 207.11, 206.19

(56) References Cited

U.S. PATENT DOCUMENTS

| | | | |
|---|---|---|---|
| 2,265,529 A | 12/1941 | Kemp | |
| 2,565,124 A | 8/1951 | Durborow | |
| 2,634,724 A | 4/1953 | Burns | 128/146 |
| 2,634,725 A | 4/1953 | Presti | |

(List continued on next page.)

FOREIGN PATENT DOCUMENTS

| | | |
|---|---|---|
| CN | 323517 | 12/1997 |
| CN | 379567 | 1/2000 |
| FR | 2 457 107 | 12/1980 |
| FR | 2 471 792 | 6/1981 |
| GB | 388638 | 3/1933 |
| GB | 871661 | 6/1961 |
| GB | 2046102 A * | 11/1980 |
| GB | 2103491 A | 2/1983 |
| JP | 8-173562 | 7/1996 |
| WO | WO 96/28216 | 9/1996 |
| WO | WO 96/28217 | 9/1996 |
| WO | WO 97/32493 | 9/1997 |
| WO | WO 97/32494 | 9/1997 |

OTHER PUBLICATIONS

Van A. Wente et al., Report No. 4364 of the Naval Research Laboratories, published May 25, 1954 entitled "Manufacture of Super Fine Organic Fibers."

Van A. Wente et al., "Superfine Thermoplastic Fibers," *Industrial Engineering Chemistry,* vol. 48, pp. 1342–1346.

C.N. Davis, "The Separation of Airborne Dust and Particles," *Institution of Mechanical Engineers,* London, Proceedings 1B, 1952.

Product Literature: "Glendale Respiratory Protection," Glendale Optical Company, Inc.

Product Literature: "Delta Disposable Respirators," Racal Health & Safety, Inc.

Product Literature: "Racal® N95 Respirator & Delta® N95 Respirator," Racal Health & Safety, Inc., (1995).

Sample of Racal respirator.

*Primary Examiner*—John G. Weiss
*Assistant Examiner*—Darwin Erezo
(74) *Attorney, Agent, or Firm*—James A. Rogers; Karl G. Hanson

(57) ABSTRACT

Respiratory devices having first and second lines of demarcation bisected by a fold. The devices are capable of being folded in a first substantially flat configuration for storage (e.g., in a pocket) and are capable of being unfolded in a second ready-to-wear configuration so that a portion of the device covering the nose and the mouth is off-the-face. Processes for making such devices include folding a preform over a bisecting axis and cutting the preform at desired angles and sealing the cuts together to form the mask.

28 Claims, 4 Drawing Sheets

U.S. PATENT DOCUMENTS

| | | | | | |
|---|---|---|---|---|---|
| 2,762,368 | A | | 9/1956 | Bloomfield | |
| 3,736,928 | A | | 6/1973 | Andersson et al. | |
| 3,971,369 | A | | 7/1976 | Aspelin et al. | |
| 4,100,324 | A | | 7/1978 | Anderson et al. | |
| D249,072 | S | * | 8/1978 | Revoir | D29/8 |
| 4,118,531 | A | | 10/1978 | Hauser | |
| 4,215,682 | A | | 8/1980 | Kubik et al. | |
| 4,375,718 | A | | 3/1983 | Wadsworth et al. | |
| RE31,285 | E | | 6/1983 | vanTurnhout et al. | |
| 4,417,575 | A | | 11/1983 | Hilton et al. | |
| 4,419,994 | A | * | 12/1983 | Hilton | 128/206.19 |
| 4,429,001 | A | | 1/1984 | Kolpin et al. | |
| 4,588,537 | A | | 5/1986 | Klaase et al. | |
| 4,592,815 | A | | 6/1986 | Nakao | |
| 4,600,002 | A | | 7/1986 | Maryyanek et al. | |
| 4,688,566 | A | | 8/1987 | Boyce | |
| 4,825,878 | A | | 5/1989 | Kuntz | |
| 4,827,924 | A | | 5/1989 | Japuntich | |
| 4,883,547 | A | | 11/1989 | Japuntich | |
| 4,944,294 | A | | 7/1990 | Borek, Jr. | |
| 5,020,533 | A | | 6/1991 | Hubbard et al. | |
| D347,090 | S | | 5/1994 | Brunson | |
| 5,322,061 | A | | 6/1994 | Brunson | |
| 5,325,892 | A | | 7/1994 | Japuntich et al. | |
| 5,496,507 | A | | 3/1996 | Angadjivand et al. | |
| 5,682,879 | A | * | 11/1997 | Bowers | 128/206.29 |
| 5,701,892 | A | | 12/1997 | Bledstein | |
| 5,706,803 | A | | 1/1998 | Bayer | |
| 5,717,991 | A | | 2/1998 | Nozaki et al. | |
| 5,724,964 | A | * | 3/1998 | Brunson et al. | 128/206.19 |
| 6,055,982 | A | * | 5/2000 | Brunson et al. | 128/206.12 |
| 6,070,579 | A | * | 6/2000 | Bryant et al. | 128/207.11 |
| 6,102,040 | A | * | 8/2000 | Tayebi et al. | 128/206.24 |
| 6,109,263 | A | * | 8/2000 | Feuchtgruber | 128/206.28 |
| 6,123,077 | A | * | 9/2000 | Bostock et al. | 128/206.12 |
| 6,125,849 | A | * | 10/2000 | Williams et al. | 128/206.12 |
| 6,148,817 | A | * | 11/2000 | Bryant et al. | 128/207.11 |

* cited by examiner

FLAT-FOLDED PERSONAL RESPIRATORY PROTECTION DEVICES AND PROCESSES FOR PREPARING SAME

FIELD OF THE INVENTION

The present invention relates to personal respiratory protection devices that are capable of being folded flat during storage and form an air chamber over the mouth and nose of a wearer during use.

BACKGROUND OF THE INVENTION

Personal respiratory protection devices, also known as filtration respirators or face masks, are used in a wide variety of applications to protect a wearer's respiratory system from particles suspended in the air or from unpleasant or noxious gases. Face masks are typically designed to be worn over the nose and the mouth to protect the wearer from undesirable material suspended in the air. Generally, these types of face masks come in two basic designs—a molded cup-shaped form or a flat-folded form.

A conventional flat-folded form of face mask is typically constructed by incorporating a fabric that is rectangular in form and includes at least one pleat running generally parallel to the mouth of the wearer. Such constructions may have a stiffening element to hold the face mask away from contact with the wearer's face. Stiffening has also been provided by fusing a pleat across the width of the face mask in a laminated structure or by providing a seam across the width of the face mask. In many applications, it is particularly desirable to provide such a face mask having a generally "flat" configuration for easy storage prior to donning the face mask. The flat-folded form has advantages in that it can be easily stored, such as in a wearer's pocket.

It has been found that flat type face masks can conform quite closely to the wearer's face, that is, most of the inner surface of the mask may come into contact with the face of the wearer. Thus, flat face masks may be warm and uncomfortable during use, and this is particularly true when the face mask is worn for extended periods of time. In addition, the inner surface of the face mask may come into contact with the wearer's mouth such that the face mask often becomes wet and abraded. When this happens, the abraded material from the inner surface may irritate the wearer.

Cup-shaped masks are typically molded masks that form an air-chamber over the face when in use thereby overcoming some of the comfort concerns related to flat folded masks. However, molded cup-shaped masks may not be folded flat for easy and convenient storage.

U.S. Pat. No. 3,971,369 to Aspelin et al. discloses a generally cup-shaped surgical mask that is not molded. The patent discloses that because the mask is not molded, the edges of the body portion of the mask are not rigid and therefore conform to the contours of the wearer's face. However, the mask is complicated to manufacture and the resulting design is pleated, having overlapping material on the front of the mask.

International Publication No. WO 96/28217 describes a flat-folded personal respiratory device. In that publication, it is described that the devices include a flat central portion, a flat first member joined to the central portion through either a fold-line, seam, weld, or bond and a flat second member joined to the central portion through either a fold-line, seam, weld, or bond. It is described that the device is capable of being folded flat for storage with the first and second members being in at least partial face to face contact with a common surface of the central portion and, during use, is capable of forming a cup-shaped air chamber over the nose and the mouth of the wearer.

SUMMARY OF THE INVENTION

There is a need for a personal respiratory protection device or face mask that is capable of being flat folded, yet provides a good respiratory seal and is comfortable to wear. There is a further need for a mask of uncomplicated design that is relatively easy and inexpensive to manufacture.

One aspect of the present invention provides a personal respiratory protection device including a non-pleated main body. Preferably, the main body includes a first portion; a second portion distinguished from the first portion by a first line of demarcation; a third portion distinguished from the second portion by a second line of demarcation; and a bisecting fold extending through the first portion, second portion and third portion; wherein the device is capable of being folded to a first substantially flat-folded configuration along the bisecting fold and is capable of being unfolded to a convex open configuration.

Preferred embodiments of the device include filter media or include a cover layer. Preferably, the device includes a stiffener layer in at least the second portion. In a preferred embodiment, the device includes a weld-line between the first and second portion which bonds the filter media, cover layer and preferably the stiffener layer together. In a particularly preferred embodiment, the device includes a second weld-line between the second portion and the third portion that bonds the layers together.

A device in accordance with the present invention preferably has the first portion extending from the second portion at an angle of about 110 degrees to about 175 degrees when measured from the bisecting fold extending through the second portion to the bisecting fold extending through the first portion when the device is folded in the substantially flat-folded configuration.

A device in accordance with the present invention preferably has the third portion extending from the second portion at an angle of about 100 degrees to about 165 degrees when measured from the bisecting fold extending through the second portion to the bisecting fold extending through the third portion when the device is folded in the substantially flat-folded configuration.

In another aspect of the present invention, a process for producing respiratory devices of different sizes from preformed blanks of the same size is described. The process includes folding a preformed blank over a bisecting axis to create a preform having a bisecting fold-line and cutting the preform at a first desired angle at a first position relative to the bisecting fold-line, wherein the first desired angle depends on a desired size and fit of the device. The size and fit of the device may be further adjusted by cutting the preform at a second desired angle at a position relative to the bisecting fold-line.

A device in accordance with the present invention may also include an optional constituent such as a face shield, a face seal, a neck cover, and a combination thereof.

Advantageously, a flat-folded face mask in accordance with the present invention preferably contacts the wearer's face at the periphery of the face mask at an acute angle with minimal facial contact to form a convex- or cup-shaped region over the nose and mouth of the wearer, thereby increasing comfort to the wearer and potentially maximizing the engagement of the perimeter of the face mask to the face of the wearer.

A process in accordance with the present invention is amenable to high speed production methods and may comprise additional steps as needed for attachment of headbands, ear loops, nosepieces, and other typical respiratory device components.

DETAILED DESCRIPTION OF THE INVENTION

Figure 1:
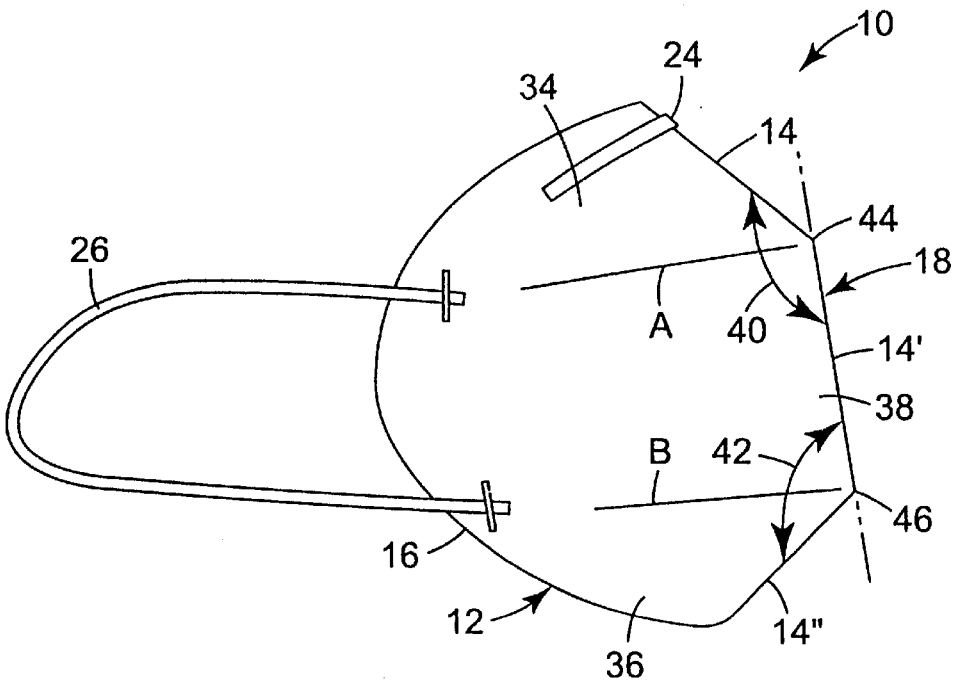
FIG. 1 is a side view of a personal respiratory protection device of the invention in a flat-fold configuration.

In one embodiment of the present invention, a personal respiratory protection device 10 is preferably capable of a flat-folded configuration, as shown in FIG. 1. The device is preferably folded in half along a line 18 that extends from a first portion 34 to a third portion 36 for storage in a package prior to use or in a wearer's pocket. In FIG. 1, one half or a side view of a folded configuration of the personal respiratory protection device 10 is shown. Preferably, the device includes a main body 12, a first portion 34, a second portion 38 and a third portion 36. These portions may be provided as separate components however, it is preferred that the first portion 34, second portion 38, and third portion 36 be completely integral to form a unitary main body 12. A device in accordance with the present invention preferably also includes attachment constituents, such as an ear attachment constituent 26 or a headband (not shown).

For the purposes of this invention, the following terms shall have the meanings as defined:

"Convex open configuration" shall mean a configuration of the device in use wherein the main body is substantially off the face of the wearer, yet is in sealing engagement with the face to provide an air chamber over the nose and mouth of the wearer. "Line of demarcation" shall mean a predetermined line in the main body 12 that distinguishes one portion 34, 36, 38 of the main body 12 from another. A line of demarcation forms an axis of rotation for one or more of the portions 34, 36, 38 to rotate at least partially around such line of demarcation. A line of demarcation may or may not extend the length or width of the main body 12. Examples of a line of demarcation include a fold-line, bond, weld-line or seam.

"Pleat" means a fold wherein the material of the device is doubled back on itself at least once in an accordion-like fashion.

"Weld-line" may or may not be a line of demarcation.

As will be described in greater detail below, the main body 12 preferably includes multiple layers that may function to filter unwanted particles suspended in the air, to protect the wearer from environmental irritation, and/or to warm the in-coming air in colder climates as the wearer inhales. A respiratory device in accordance with the present invention includes a first line of demarcation A and a second line of demarcation B that define the second portion 38 therebetween. These lines of demarcation provide two laterally extending axes of rotation for movement of the first portion 34 about the line of demarcation A and of the third portion 36 about the second line of demarcation B. That is, these lines of demarcation have a joint-like function that imparts movement to the first and the third portions relative to the second portion and imparts structural integrity to the second portion during wear. It was found that these lines of demarcation improve flexibility and conformance of the device during wear around the nose and the chin of the wearer. In one preferred embodiment, the personal respiratory device includes a multi-layer construction. In this embodiment, the lines of demarcation can prevent delamination of the multi-layers such that the inner layer does not collapse during use. Preferably, the lines of demarcation are welds, because welds impart good structural integrity and prevent delamination.

The lines of demarcation can be formed by a variety of techniques suitable to form an axis of rotation. Suitable techniques include welding (e.g., ultrasonic welding), application of pressure (with or without heat), application of adhesive bars, stitching, and the like. It is to be understood that the lines of demarcation can be substantially continuous, discontinuous, straight, curvilinear, and a combination thereof, so long as the lines of demarcation impart an axis of rotation for movement of the first portion 34 about the line of demarcation A and of the third portion 36 about the second line of demarcation B.

In a preferred embodiment, at least one line of demarcation includes a weld-line and, more preferably, both lines of demarcation include weld-lines. Preferably, the lines of demarcation do not include and are not part of a pleat.

A bisecting fold 18 preferably includes a first fold 14, a second fold 14', and a third fold 14". An edge seal 16 that extends from the first fold 14 to the third fold 14" as shown finishes the configuration of the device. The folds 14 and 14" are preferably formed by welds, as will be described below, that can be straight or curvilinear, but are preferably substantially straight as shown. However, the fold may be formed by other means in the art, such as stitching. The ear attachment constituent 26 is provided to hold the device in place on a wearer's face, typically by securing around the ears of the wearer. Other constituents, such as a headband, can be added to a personal respiratory device in accordance with the present invention to hold the device in place on the wearer's head.

Figure 2:
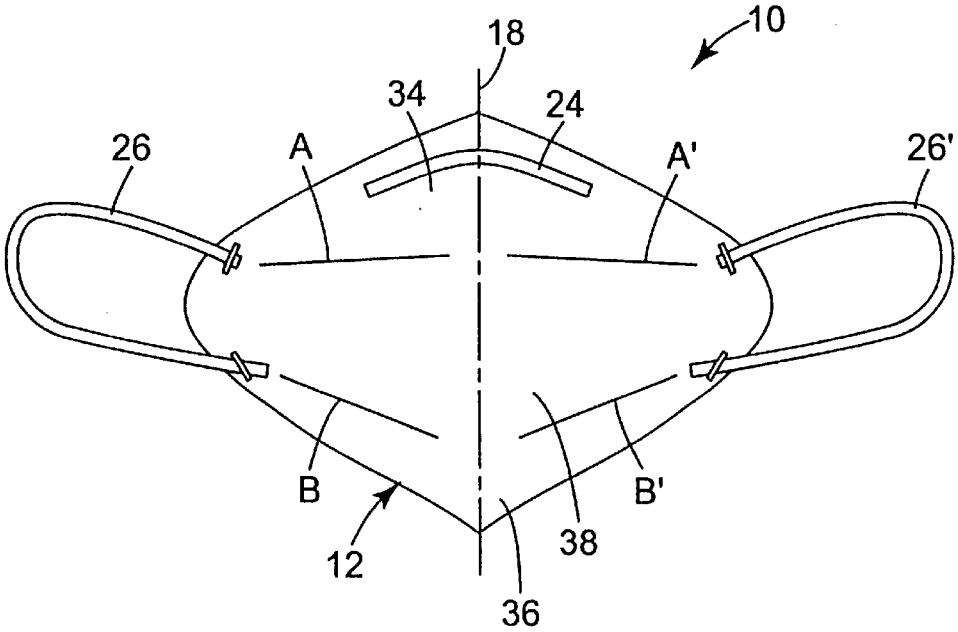
FIG. 2 is a front view of the personal respiratory protection device of FIG. 1 shown in an open ready-to-use configuration.

The personal respiratory protection device 10 is shown in FIG. 2, where common parts are identified as in FIG. 1, in its ready-to-wear convex open configuration having the general shape of a cup or pouch which provides the wearer with the "off-the-face" benefits of a "cup-shaped" respiratory device. This configuration allows the wearer a greater degree of jaw movement and wearer comfort because the device is substantially not in contact with the wearer's face in the mouth area. In accordance with the present invention, this configuration is preferably accomplished in the absence of pleat(s) running horizontally on the main body 12. Rather, a device in accordance with the present invention preferably includes a bisecting fold extending from the first portion to the third portion of the device, wherein the device is essentially divided into a first half and a second half. Aside from the bisecting fold, no other fold-lines are necessary to achieve a substantially flat-folded configuration of the device.

Preferably, the second or center portion 38 is less compliant than the first portion 34 and the third portion 36. A less compliant center portion included in a personal respiratory device in accordance with the present invention advantageously enhances the convex open configuration, thus contributing to the off-the-face benefits during wear.

The shape and the size of a personal respiratory device 10 of the present invention may be varied by varying the shape and angle of the folds 14 and 14", which can be straight to curvilinear, preferably substantially straight, as desired to achieve good conformance to the wearer's face. The folds 14 and 14" are each preferably formed by a weld line that results in a first angle 40 and a second angle 42, from a first point of origin 44 and a second point of origin 46 along the second fold 14', respectively. Preferably, the first angle 40, formed and measured from the second fold 14' to the first fold line 14, is about 110 degrees to about 175 degrees, more preferably about 140 degrees to about 155 degrees. Preferably, the second angle 42, formed and measured from the second fold 14' to the third fold line 14", is about 100 degrees to about 165 degrees, more preferably about 135 degrees to about 150 degrees. By varying the shape of the fold lines 14 and 14", the first angle 40, and the second angle 42, the conformance of the respiratory device to the face can be easily altered to conform to varying face sizes. One with ordinary skill in the art will appreciate that by varying the angles of each of the first angle 40 and the second angle 42 from the second fold 14', the length of the first fold 14 and the third fold 14" will also vary accordingly. Preferably, however, first and third fold lines 14 and 14" typically vary within a length range of about 40 mm to about 80 mm, wherein the first fold line and the third fold line are not necessarily the same length.

In view of the foregoing, a personal respiratory device in accordance with the present invention typically has a height (measured from the outer edge of the first portion to the outer edge of the second portion) in the convex open configuration of about 90 mm to about 160 mm, preferably from about 100 mm to about 150 mm, and more preferably from about 110 mm to about 140 mm. The height of the second portion 38 of the respiratory device 10 formed between lines of demarcation A, A' and B, B' is preferably about 30 mm to about 100 mm in height, more preferably about 35 mm to about 75 mm in height, most preferably about 45 mm to about 65 mm in height. Additionally, a personal respiratory device in accordance with the present invention typically has a width (measured from the outer edge of the right edge seal to the outer edge of the left edge seal) in the convex open configuration of about 110 mm to about 190 mm, preferably from about 130 mm to about 170 mm, and more preferably from about 140 mm to about 160 mm.

As briefly mentioned above, a personal respiratory device in accordance with the present invention preferably includes a multilayer construction having at least one cover layer and a filter layer. An optional stiffener layer may also be included. The filter layer includes media or material that is preferably included in at least the center portion of the device. The filter layer may be comprised of a number of woven and nonwoven materials, a single or a plurality of layers, with or without an inner or outer cover layer. As mentioned above, the center portion is formed between the lines of demarcation laterally extending from the bisecting fold line. Examples of suitable filter material include microfiber webs, fibrillated film webs, woven or nonwoven webs (e.g., airlaid or carded staple fibers), solution-blown fiber webs, or combinations thereof. Fibers useful for forming such webs include, for example, polyolefins such as polypropylene, polyethylene, polybutylene, poly(4-methyl-1-pentene) and blends thereof, halogen substituted polyolefins such as those containing one or more chloroethylene units, or tetrafluoroethylene units, and which may also contain acrylonitrile units, polyesters, polycarbonates, polyurethanes, rosin-wool, glass, cellulose or combinations thereof.

Fibers of the filtering layer are selected depending upon the type of particulate to be filtered. Proper selection of fibers can also affect the comfort of the respiratory device to the wearer, e.g., by providing softness or moisture control. Webs of melt blown microfibers useful in the present invention can be prepared as described, for example, in Wente, Van A., "Superfine Thermoplastic Fibers" in *Industrial Engineering Chemistry*, Vol. 48, 1342 et seq. (1956) and in Report No. 4364 of the Naval Research Laboratories, published May 25, 1954, entitled "Manufacture of Super Fine Organic Fibers" by Van A. Wente et al. The blown microfibers in the filter media useful on the present invention preferably have an effective fiber diameter of from 3 to 30 micrometers, more preferably from about 7 to 15 micrometers, as calculated according to the method set forth in Davies, C. N., "The Separation of Airborne Dust Particles," Institution of Mechanical Engineers, London, Proceedings 1B, 1952.

Staple fibers may also, optionally, be present in the filtering layer. The presence of crimped, bulking staple fibers provides for a more lofty, less dense web than a web consisting solely of blown microfibers. Preferably, no more than 90 weight percent staple fibers, more preferably no more than 70 weight percent are present in the media. Such webs containing staple fiber are disclosed in U.S. Pat. No. 4,118,531 (Hauser).

Bicomponent staple fibers may also be used in the filtering layer or in one or more other layers of the filter media. The bicomponent staple fibers which generally have an outer layer which has a lower melting point than the core portion can be used to form a resilient shaping layer bonded together at fiber intersection points, e.g., by heating the layer so that the outer layer of the bicomponent fibers flows into contact with adjacent fibers that are either bicomponent or other staple fibers. The shaping layer can also be prepared with binder fibers of a heat-flowable polyester included together with staple fibers and upon heating of the shaping layer the binder fibers melt and flow to a fiber intersection point where they surround the fiber intersection point. Upon cooling, bonds develop at the intersection points of the fibers and hold the fiber mass in the desired shape. Also, binder materials such as acrylic latex or powdered heat activatable adhesive resins can be applied to the webs to provide bonding of the fibers.

Electrically charged fibers, such those disclosed in U.S. Pat. No. 4,215,682 (Kubik et al.), U.S. Pat. No. 4,588,537 (Klasse et al.), or by other conventional methods of polarizing or charging electrets, e.g., by the process of U.S. Pat. No. 4,375,718 (Wadsworth et al.), or U.S. Pat. No. 4,592,815 (Nakao), or by a hydrocharging method described in U.S. Pat. No. 5,496,507 (Angadjivand et al.) are particularly useful in the present invention. Electrically charged fibrillated-film fibers as taught in U.S. Pat. No. RE. 31,285 (van Turnhout), are also useful.

Sorbent particulate material (such as activated carbon or alumina) and/or sorbent fibers (e.g., activated carbon fibers) may also be included in the filtering layer. Such particle-loaded webs are described, for example, in U.S. Pat. No. 3,971,373 (Braun), U.S. Pat. No. 4,100,324 (Anderson) and U.S. Pat. No. 4,429,001 (Kolpin et al.). Masks from particle loaded filter layers are particularly good for protection from gaseous materials. As mentioned above, a respiratory device for filtering airborne particulates of the present invention must include a filter layer in at least the one portion. Preferably, the entire respiratory device in accordance with the present invention includes a filter layer.

Optional Device Constituents

A personal respiratory device in accordance with the present invention may include at least one optional constituent as described herein. For example, the first portion may include a material that provides a moisture barrier to prevent fogging of a wearer's glasses.

Additionally, personal respiratory devices of the present invention are typically held in place on a wearer's face by constituents well-known to those skilled in the art such as with straps or bands, preferably as ear loops and/or headbands. For example, ear loops can be stapled to the respiratory device main body as shown in FIGS. 1 and 2, or they may be adhered to the main body of the respiratory device by means such as embossing, adhesive bonding, ultrasonic welding, sewing or other means commonly known to those skilled in the art. In accordance with the present invention, a personal respiratory device preferably has some degree of adjustability to effect tension against the wearer's face with or without the use of a headband.

Straps or bands useful in the present invention may be constructed from thermoplastic elastomers, resilient polyurethane, polyisoprene, butylene-styrene copolymers. One such example is a styrene-butadiene-styrene block copolymer, commercially available under the trade designation KRATON D 1101, from Shell Chemical Co., Houston, Tex. Straps or bands may also be constructed from elastic rubber or a covered stretch yarn, such as that commercially available under the trade designation LYCRA, from DuPont Co., Wilmington, Del. Also useful for straps or bands in the present invention are stretch activated, elastomeric composite materials. One such material is a non-tacky, multi-layer elastomeric laminate having at least one elastomeric core and at least one relatively nonelastomeric skin layer. The skin layer is stretched beyond its elastic limit and is relaxed with the core so as to form a microstructured skin layer. Microstructure means that the surface contains peak and valley irregularities or folds which are large enough to be perceived by the unaided human eye as causing increased opacity over the opacity of the composite before microstructuring, and which irregularities are small enough to be perceived as smooth or soft to human skin. Magnification of the irregularities is required to see the details of the microstructured texture. Examples of such elastomeric composites are disclosed in U.S. Pat. No. 5,501,679 (Krueger).

Although elastic bands are preferable, non-elastic bands may also be used in the present invention and include, for example, non-woven materials formed by both wet-laid or dry-laid processes and consisting of rayon, polyester or like fibers, calendared spun-bonded webs of polypropylene, polyethylene or polyester and reinforced paper. The bands can be tied, clasped, or stretched such that the bands encircle the head of the wearer bringing the facemask in sealing engagement with the face of the wearer.

The respiratory device may also include an optional exhalation valve, typically a diaphragm valve, which allows for the easy exhalation of air by the user. An exhalation valve having extraordinary low pressure drop during exhalation for the mask is described in U.S. Pat. No. 5,325,892 (Japuntich et al.). Many exhalation valves of other designs are well known to those skilled in the art. The exhalation valve is preferably secured to the center portion, preferably near the middle of the center portion, by sonic welds, adhesion bonding, mechanical clamping or the like.

The respiratory device may optionally have attached, at the upper edge or outboard portions of the respiratory device, a face shield. Typical face shields are disclosed, for example, in U.S. Pat. No. 2,762,368 (Bloomfield) and U.S. Pat. No. 4,944,294 (Borek, Jr.). Also useful is the type of face shield disclosed in U.S. Pat. No. 5,020,533 (Hubbard et al.), which has a cutout proximate the center of the shield to facilitate conformance of the respiratory device and shield to the face of the wearer with a darkened strip at the top edge of the device to reduce glare.

Further, face seals which minimize leakage of air between the device and the face may also optionally be used with the respiratory device of the present invention. Typical face seals are described, for example, in U.S. Pat. No. 4,600,002 (Maryyanek et al.), U.S. Pat. No. 4,688,566 (Boyce), and U.S. Pat. No. 4,827,924 (Japuntich), which describes a ring of soft elastomeric material on a respiratory device 75.

Also, neck covers that protect the neck area from, for example, splashing liquids, may also be used with the respiratory devices of the present invention. Typical neck covers are disclosed, for example in U.S. Pat. No. 4,825,878 (Kuntz et al.), U.S. Pat. No. 5,322,061 (Brunson), and U.S. Pat. No. Des. 347,090 (Brunson).

NOSEPIECE

In order to afford comfort and conformance, any personal respiratory device may include a two-part nosepiece. As used herein, "two-part," when referring to a nosepiece, refers to a configuration wherein a respiratory device or mask includes a first nosepiece part on a right side of the respiratory device and a second nosepiece on a left side of the respiratory, wherein the two parts are not joined across the nose when the device is donned by the wearer. Advantageously, a two-part nosepiece decreases the likelihood of the formation of a "peak" like configuration. In conventional masks including a nosepiece as a single part, a sharply pointed gap or "peak" may form over the nose because the single part nosepiece bends to accommodate the curvature of the bridge of the nose. The gap or peak is undesirable because moist breath air exhaled by the wearer tends to fog a wearer's glasses. Any respiratory device can include a two-part nosepiece to improve conformance over the wearer's nose, such as those that are commercially available under the trademarks 8210™, 8210i™, 8246™, 8247™, 1860™, 8110S™, 8218™, 8710™, and 2610™, all from Minnesota Mining and Manufacturing Company, St. Paul, Minn.

Advantageously, a two-part nosepiece permits conformance on the cheek area on either side of the nose while also permitting greater conformance over the bridge of the nose because that portion of the rigid nosepiece covering the bridge of the nose is absent. Thus, improved conformance over the nose is observed when a respiratory device includes a two-part nosepiece. Furthermore, the manufacturing of a respiratory device including a two-part nosepiece can be simplified. For example, a two-part nosepiece can be added to the respiratory device at any point during the process, including prior to folding the device. In conventional manufacturing processes, a single part nosepiece is typically added once the device is folded so that the single part nosepiece resides on either side of the fold and on the fold itself. Because the nosepiece can be added in two parts on either side of the substantially vertical line, the two-part nosepiece can be added to a substantially flat preform (described below) at any point in the manufacturing process. For example, the two-part nosepiece can be attached to a surface of a cover layer so that the two-part nosepiece is encased within the device (so that the nosepiece is invisible to the wearer) or on an exterior surface of the device.

A nosepiece useful in the respiratory device of the present invention may include a single part nosepiece or a two-part nosepiece. In any embodiment, the nosepiece can be made of a formable material for example, a pliable dead-soft band of metal such as aluminum or plastic coated wire and can be shaped to conform the device comfortably to a wearer's face. Additionally, a non-linear nosepiece configured to extend over the bridge of the wearer's nose having inflections disposed along the clip section to afford wings that assist in providing a snug fit of the mask in the nose and cheek area. The nosepiece may be secured to the respiratory device by an adhesive, for example, a pressure sensitive adhesive, a liquid hot-melt adhesive, or ultrasonic welding. Alternatively, the nosepiece may be encased in the body of the respiratory device or it may be held between the device body and a fabric or foam that is mechanically or adhesively attached thereto. In an embodiment of the invention such as is shown in FIG. 2, the nosepiece is positioned on the outside part of the nose portion. Because the nose portion is more compliant than the center portion, a respiratory device in accordance with the present invention preferably does not require the presence of a foam piece. If included, a foam piece is typically disposed between a respiratory device in alignment with the nosepiece for added comfort to the wearer.

Personal respiratory devices of the present invention can be sterilized by any standard method, such as gamma radiation, exposure to ethylene oxide, or autoclaving.

METHOD FOR MAKING A RESPIRATORY DEVICE

A flat-folded respiratory device, such as that illustrated in FIG. 1, is preferably formed from a single piece, although multiple pieces can be attached to one another using the various techniques described herein, such as a batch process (e.g., by plunge welding) or a continuous process (e.g., rotary welding). In either process, a flat-folded respiratory device is preferably produced by forming a substantially flat sheet of a multilayer construction (also referred to herein as a "preform") by bonding and cutting the outer forming edges. Other techniques may be employed for forming the edges utilizing other techniques, such as ultrasonic welding, stitching, and the application of pressure to form the edges (with or without the addition of heat).

Figure 3:
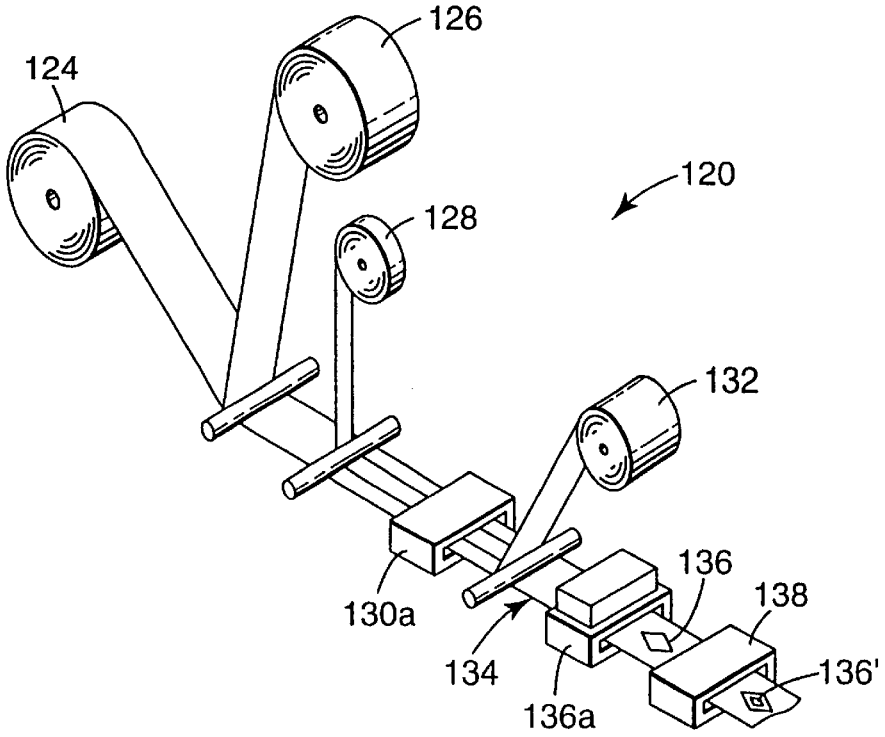
FIG. 3 is a schematic illustration of an exemplary manufacturing process for producing a flat-folded personal respiratory protection device.

In accordance with the present invention, a substantially flat preform can have any shape. As shown in FIG. 3, the substantially flat preform 136 has a diamond shape, although other shapes (e.g., pentagonal, hexagonal, semicircular, square, butterfly, etc.) are equally suitable. A process in accordance with the present invention also includes forming at least one line of demarcation within the preform; folding the preform along a substantially bisecting axis; and forming a first angle and a second angle.

FIG. 3 is a schematic illustration of one production process 120 for manufacturing a flat-folded respiratory devices such as shown in FIG. 1. An inner cover web 124 and a filter layer 126 are preferably supplied in roll form for a substantially continuous process. In an alternate embodiment, the nosepiece 24 (for example, as a two-part nosepiece described above) may be positioned on an outer or an inner surface of either the inner cover web 124 or outer cover web 132. A stiffening material 128 is preferably positioned proximate the center of the filter layer 126. The filter layer 126 and the stiffening material 128 are covered by an outer cover web 132 to form a web assembly 134. The web assembly 134 may be held together by surface forces, electrostatic forces, thermal bonding, an adhesive or any other suitable well-known means.

As is illustrated in FIG. 3, the web assembly 134 can be welded and trimmed to form a preform 136 at welding station 136*a*. Preferably, the preform 136 is substantially flat such that a face mask in accordance with the present invention can be formed a relatively high rates of speed and at a relatively low cost because conventional components, such as molded support shells, are not required. Further, the preform 136 then passes through a demarcation station 138. In the demarcation station 138, at least one line of demarcation is formed in the preform to form a demarked preform 136'. A line of demarcation can be formed by a variety of techniques including ultrasonic welding, application of pressure (with or without the presence of heat), stitching, application of adhesive bars, and the like.

Figure 4A:
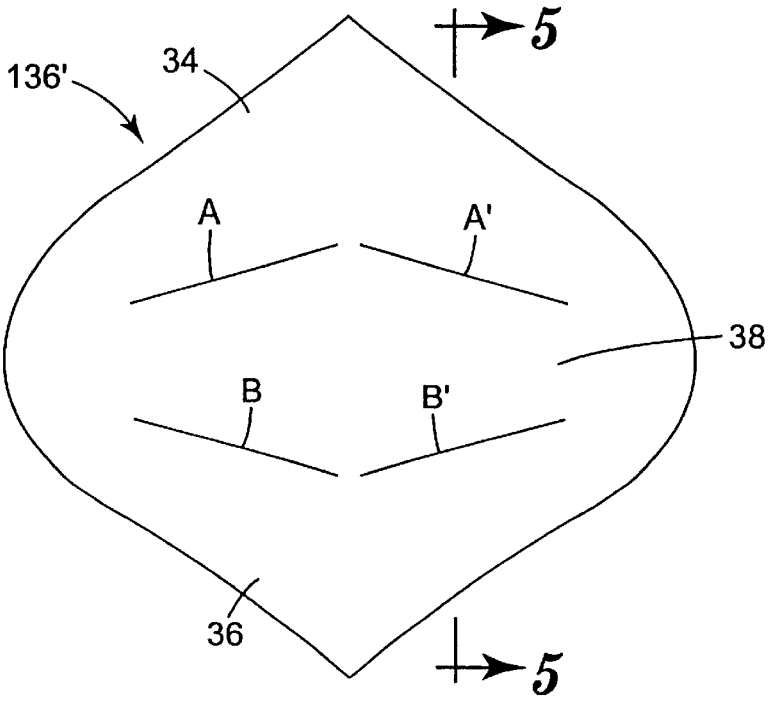
FIGS. 4*a*–4*c* is a schematic illustration of an assembly process utilizing a single preform resulting from an exemplary manufacturing process of FIG. 3.
Figure 5:
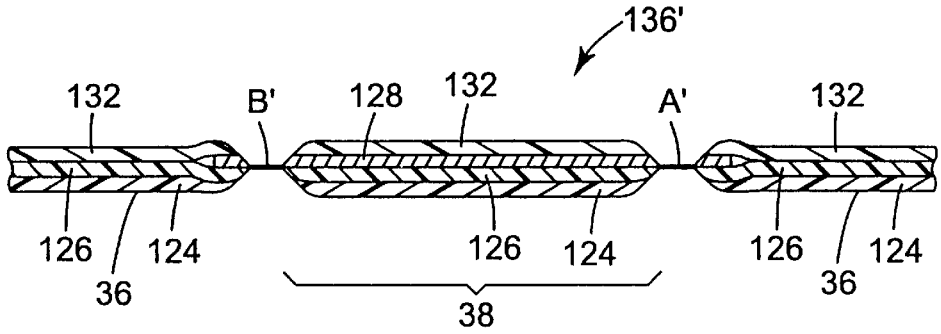
FIG. 5 is a cross-section taken along line 5—5 of a single preform of FIG. 4*a*.

As shown in FIG. 4*a*, the demarked preform 136' includes lines of demarcation A, A', B, and B'. As discussed above, the lines of demarcation function to prevent delamination of the layers in the preform, to add stiffness to the second portion of the face mask during wear, and to provide greater flexibility of the first portion and the third portion relative to the second portion. FIG. 5, taken across line 5—5 in FIG. 4*a*, illustrates a cross-section of a welded preform 136'. The second portion 38 preferably includes an outer layer 132, a stiffening material layer 128, a filter layer 126, and an inner layer 124. The first portion 34 and the third portion 36 preferably include the outer layer 132, the filter layer 126, and the inner layer 124. As mentioned above, the stiffening material 128 is preferably absent from each of the first portion 34 and the third portion 26. As shown in FIG. 5, a slight extension of the stiffening material 128 may be necessary in the first portion, the third portion, or both so that all layers can be attached via the lines of demarcation. Alternatively, the stiffening material 128 may extend into the lines of demarcation but no further or it may extend to just inside the lines of demarcation so that the stiffening material is located within a pocket formed by the lines of demarcation.

Figure 4B:
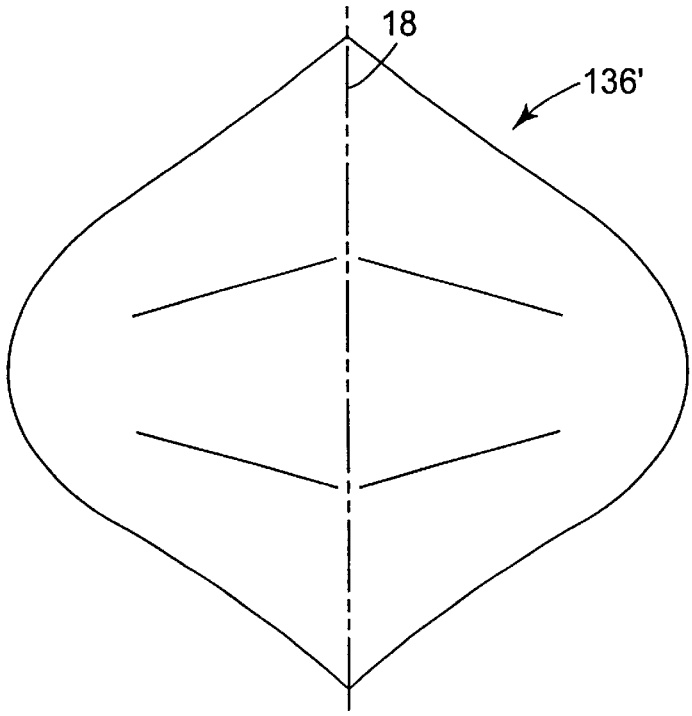
Figure 4C:
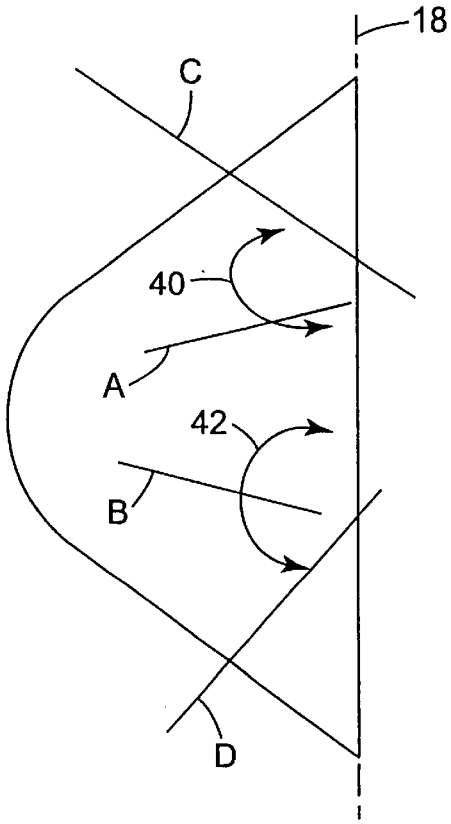

Referring now to FIG. 4*b*, the demarked preform 136' is preferably folded along bisecting fold 18 parallel to a substantially vertical axis along the midsection of the length of the welded preform 136'. As shown in FIG. 4*c* and FIG. 1, a folded preform 136" is then welded and cut along lines C and D, each at predetermined angles relative to the second fold line 14', to form fold lines 14 and 14", respectively. As mentioned above, the demarked preform 136' is preferably formed from a single piece. However, multiple pieces can be joined along fold lines 14, 14', and 14" such that any or all of these fold lines include a weld line. Preferably, fold line 14' does not include a weld line.

Each of the predetermined angles of lines C and D can be varied independently to adjust the size and shape of the resulting face mask by adjusting the first portion and/or the third portion. For example, the folded preform can be welded and cut along line C so that the fold line 14 is provided at an angle of about 147 degrees relative to the second fold line 14' to form the nose portion. Similarly, the folded preform can be welded and cut along line D so that the third fold line 14" is provided at an angle of about 142 degrees relative to the second fold line 14' to form the third portion. As mentioned above, these angles can be easily varied to accommodate a variety of face sizes and shapes.

A process in accordance with the present invention is preferably capable of high speed production methods and may comprise additional steps as needed for attachment of headbands, nosepieces, and other typical respiratory device components.

The following examples further illustrate this invention, but the particular materials, shapes and sizes thereof in these examples, as well as other conditions and details should not be construed to unduly limit this invention.

EXAMPLES

Personal respiratory protection devices of the present invention are further described by way of the non-limiting examples set forth below. In each of the examples, an ultrasonic welding unit was utilized that is commercially available under the trade designation model 1300 P from Branson Ultrasonics Corporation, Danbury, Conn. For each of the welding operations in the following examples, the settings of the welding unit were as follows:

| Parameter | Value |
|---|---|
| Power output | 90–100% |
| Weld time | 1.5 seconds |
| *Hold time | 2.5 seconds |
| Weld pressure | 90 psi |

*Hold time refers to the time period during which the preform was held under pressure in the absence of ultrasonic power.

In each of the examples, individual materials that formed the layers were assembled in the following order:

1. Outer cover web
2. Stiffener
3. Filter material
4. Inner cover web

Figure 6:
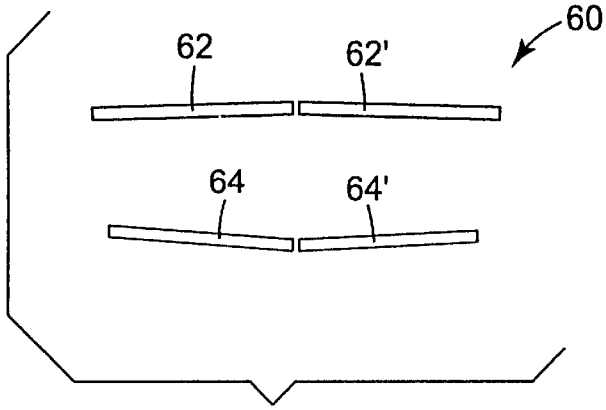
FIG. 6 is a schematic illustration of an anvil utilized to form weld-lines in a device in accordance with the present invention.
Figure 7:
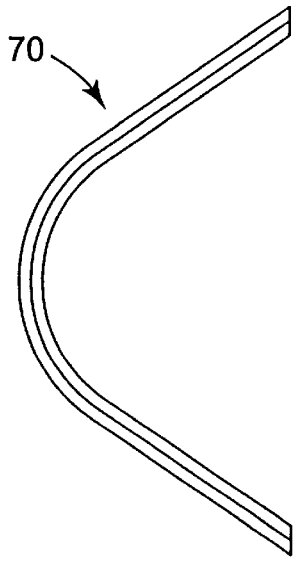
FIG. 7 is a schematic illustration of an anvil utilized to form a preform in the process for making a device in accordance with the present invention.

The materials were layered together and then welded together using an anvil 60 as shown in FIG. 6, where weld protrusions 62, 62', 64, and 64' pressed into the layered material to form the lines of demarcation A, A', B, and B', respectively, as illustrated in FIG. 4*a*. Next, the diamond-shaped preform was formed utilizing an anvil 70 illustrated in FIG. 7. The anvil 70 was first pressed into the layered material including the lines of demarcation, resulting in the left half of the welded preform. Next, the anvil 70 was rotated 180 degrees and pressed into the layered material such that the first compression described above and this second compression completed the formation of the welded preform as illustrated in FIG. 4*a*. A folded preform was formed, and welded along lines C and D, as shown in FIG. 4*c*.

Each of the Examples below contained an filter material that was a layer of electrically charged melt blown polypropylene microfibers with a fiber diameter of about 7 to about 8 microns and a basis weight of about 50 grams per square meter.

Additionally, each of the Examples below included a nosepiece, whether a single part or a two-part nosepiece. Each of the nosepieces was formed from a dead soft aluminum band having a width of about 5 mm and a thickness of about 0.8 mm. For a single part nosepiece, the length was about 87 mm. For a two-part nosepiece, the length of each part was about 38 mm.

EXAMPLE 1

A personal respiratory device including ear loops.

| Item | Supplier Description | Supplier | Material |
|---|---|---|---|
| Outer cover web | Daltex 1-50-B1-U00 | Don and Low Nonwovens, Forfar, Scotland, United Kingdom | Spunbonded polypropylene 50 grams per square meter |
| Stiffener | Colprop PXP75 | Akzo Nobel Nonwovens, Arnhem Netherlands | Spunbonded polypropylene 75 grams per square meter |
| Inner cover web | Daltex LS LS 1043 | Don and Low Nonwovens, Forfar, Scotland, United Kingdom | Spunbonded polypropylene 20 grams per square meter |
| Ear loops | | | Formed from Kraton D 1101 (Shell, Houston, TX) having the dimensions of 4.8 mm wide, 220 mm long, 1 mm thick (2 each) |
| Staples | STH5019 ¼ | Stanley Bostitch East Greenwich, RI | Steel |

EXAMPLE 2

A personal respiratory device including adjustable ear loops.

| Item | Supplier Description | Supplier | Material |
|---|---|---|---|
| Outer cover web | Daltex 1-50-B1-U00 | Don and Low Nonwovens, Forfar, Scotland, United Kingdom | Spunbonded polypropylene 50 grams per square meter |
| Stiffener | Colprop PXP75 | Akzo Nobel Nonwovens, Arnhem Netherlands | Spunbonded polypropylene 75 grams per square meter |
| Inner cover web | Daltex LS 1043 | Don and Low Nonwovens, Forfar, Scotland, United Kingdom | Spunbonded polypropylene 20 grams per square meter |
| Ear loops | | | Formed from polyisoprene, having the dimensions of 4.8 mm wide, 22 cm long, 0.5 mm thick (2 each) |
| Staples | STH5019 ¼ | Stanley Bostitch East Greenwich, RI | Steel |
| Staples | Standard staples | Stanley Bostitch East Greenwich, RI | Steel |

EXAMPLE 3

A personal respiratory device including a netting as a stiffener.

| Item | Supplier Description | Supplier | Material |
|---|---|---|---|
| Outer cover web | Lightweight Filtration Netting 37-4057 | Naltex Plastics, Inc., Austin TX | Polypropylene extruded netting |
| Stiffener | Colprop PXP75 | Akzo Nobel Nonwovens, Arnhem Netherlands | Spunbonded polypropylene 75 grams per square meter |
| Inner cover web | Daltex LS LS 1043 | Don and Low Nonwovens, Forfar, Scotland, United Kingdom | Spunbonded polypropylene 20 grams per square meter |
| Ear loops | | | As in Example 1 |
| Staples | STH5019 ¼ | Stanley Bostitch East Greenwich, RI | Steel |

EXAMPLE 4

A personal respiratory device without a stiffening layer and including a braided headband.

| Item | Supplier Description | Supplier | Material |
|---|---|---|---|
| Outer cover web | Daltex 1-50-B1-U00 | Don and Low Nonwovens, Forfar, Scotland, United Kingdom | Spunbonded polypropylene 50 grams per square meter |
| Inner cover web | Daltex LS 1043 | Don and Low Nonwovens, Forfar Scotland, United Kingdom | Spunbonded polypropylene 20 grams per square meter |
| Headband | G-9-10-1 | Providence Braid Co., Pawtucket, RI | Polypropylene-Polyisoprene 4.8 mm × 343 mm × 1 mm (2 each) |
| Staples | STH5019 ¼ | Stanley Bostitch East Greenwich, RI | Steel |

EXAMPLE 5

A personal respiratory device was designed including a two-part nosepiece and braided ear loops.

| Item | Supplier Description | Supplier | Material |
|---|---|---|---|
| Outer cover web | Daltex 1-50-B1-U00 | Don and Low Nonwovens, Forfar, Scotland, United Kingdom | Spunbonded poly propylene 50 grams per square meter |
| Stiffener | Colprop PXP75 | Akzo Nobel Nonwovens, Arnhem Netherlands | Spunbonded polypropylene 75 grams per square meter |
| Inner cover web | Daltex LS 1043 | Don and Low Nonwovens, Forfar, Scotland, United Kingdom | Spunbonded polypropylene 20 grams per square meter |

-continued

| Item | Supplier Description | Supplier | Material |
|---|---|---|---|
| Ear loops | G-9-10-1 | Providence Braid Co., Pawtucket, RI | Polypropylene-Polyisoprene 4.8 mm × 210 mm × 1 mm (2 each) |
| Staples | STH5019 ¼ | Stanley Bostitch East Greenwich, RI | Steel |

Each of the personal respiratory devices in the Examples above exhibited good fit and off-the-face characteristics. It was surprising that these well conforming personal respiratory devices could be easily fabricated from a single substantially flat multilayer piece.

Personal respiratory devices of the present invention include, for example, respirators, surgical masks, clean room masks, face shields, dust masks, breath warming masks, and a variety of other face coverings. The respiratory devices of the present invention provide improved sealing engagement with the wearer's face as compared to some other conventional types of flat-folded face masks.

Patents and patent applications disclosed herein are hereby incorporated by reference as if individually incorporated. It is to be understood that the above description is intended to be illustrative, and not restrictive. Various modifications and alterations of this invention will become apparent to those skilled in the art from the foregoing description without departing from the scope and the spirit of this invention, and it should be understood that this invention is not to be unduly limited to the illustrative embodiments set forth herein.

What is claimed is:

1. A personal respiratory protection device comprising:

a non-pleated main body comprising:

a first portion;

a second portion distinguished from the first portion by a first line of demarcation;

a third portion distinguished from the second portion by a second line of demarcation; and a bisecting fold that is substantially vertical when viewed from the front when the device is oriented as in use on a wearer, the substantially vertical bisecting fold extending through the first portion, second portion and third portion;

wherein the device is capable of being folded to a first substantially flat-folded configuration along the bisecting fold and is capable of being unfolded to a convex open configuration.

2. The device of claim 1, wherein the device includes filter media.

3. The device of claim 2, wherein the device includes a cover layer.

4. The device of claim 3, wherein the device includes a stiffener layer.

5. The device of claim 4, wherein the first portion and the third portion are substantially free of the stiffener layer.

6. The device of claim 4, wherein the first line of demarcation includes a weld-line extending substantially coextensive therewith and wherein the weld-line bonds the filter media, cover layer and stiffener layer together.

7. The device of claim 6, wherein the second line of demarcation includes a weld-line extending substantially coextensive therewith wherein the weld-line bonds the filter media, cover layer and stiffener layer together.

8. The device of claim 1, wherein the main body comprises one piece.

9. The device of claim 1, wherein the bisecting fold comprises a first weld in the first portion.

10. The device of claim 1, wherein the bisecting fold comprises a second weld in the third portion.

11. The device of claim 1, wherein the first portion extends from the second portion at an angle of about 110 degrees to about 175 degrees when measured from the bisecting fold extending through the second portion to the bisecting fold extending through the first portion when the device is folded in the substantially flat-folded configuration.

12. The device of claim 1, wherein the third portion extends from the second portion at an angle of about 100 degrees to about 165 degrees when measured from the bisecting fold extending through the second portion to the bisecting fold extending through the third portion when the device is folded in the substantially flat-folded configuration.

13. A method for producing respiratory devices, comprising folding a preformed blank over a bisecting axis to create a preform having a bisecting fold-line and cutting the preform at a first desired angle at a first position relative to the bisecting fold-line, wherein the first desired angle depends on a desired size of the device.

14. The method of claim 13 comprising the additional step of cutting the preform at a second desired angle at a second position relative to the bisecting fold-line, wherein the second desired angle depends on a desired size of the device.

15. A personal respiratory device comprising:

a non-pleated main body comprising:

a first portion;

a second portion distinguished from the first portion by a first line of demarcation;

a third portion distinguished from the second portion by a second line of demarcation; and a bisecting fold extending through the first portion, second portion and third portion, the bisecting fold being oriented vertically when the device is viewed from the front and is oriented upright as in use on a wearer;

wherein the lines of demarcation laterally extend from the bisecting fold and the device is capable of being folded to a first substantially flat-folded configuration along the bisecting fold and is capable of being unfolded to a convex open configuration.

16. The device of claim 15, wherein aside from the bisecting fold, no other fold-lines are necessary to achieve a substantially flat-folded configuration of the device.

17. The device of claim 15, wherein the second portion is formed between the lines of demarcation.

18. The device of claim 15, wherein the lines of demarcation improve flexibility and conformance of the device around the nose and chin of a wearer.

19. The device of claim 15, wherein the lines of demarcation add stiffness to the second portion of the device.

20. The device of claim 15, wherein the lines of demarcation provide greater flexibility of the first portion and the third portion relative to the second portion.

21. The device of claim 15, wherein the device includes a cover layer and a stiffener layer and the lines of demarcation prevent delamination of the cover layer and stiffener layer.

22. A personal respiratory protection device comprising:

a non-pleated main body comprising:

a first portion;

a second portion distinguished from the first portion by a first line of demarcation;

a third portion distinguished from the second portion by a second line of demarcation; and a bisecting fold extending through the first portion, second portion and third portion;

wherein the lines of demarcation do not intersect and the device is capable of being folded to a first substantially flat-folded configuration along the bisecting fold and is capable of being unfolded to a convex open configuration.

23. The device of claim 22, wherein aside from the bisecting fold, no other fold-lines are necessary to achieve a substantially flat-folded configuration of the device.

24. The device of claim 22, wherein the second portion is formed between the lines of demarcation.

25. The device of claim 22, wherein the lines of demarcation improve flexibility and conformance of the device around the nose and chin of a wearer.

26. The device of claim 22, wherein the lines of demarcation add stiffness to the second portion of the device.

27. The device of claim 22, wherein the lines of demarcation provide greater flexibility of the first portion and the third portion relative to the second portion.

28. The device of claim 22, wherein the device includes a cover layer and a stiffener layer and the lines of demarcation prevent delamination of the cover layer and stiffener layer.

* * * * *

UNITED STATES PATENT AND TRADEMARK OFFICE

CERTIFICATE OF CORRECTION

PATENT NO. : 6,394,090 B1
DATED : May 28, 2002
INVENTOR(S) : Chen, Daniel T.

It is certified that error appears in the above-identified patent and that said Letters Patent is hereby corrected as shown below:

Column 13,
Line 17, delete "LS"

Signed and Sealed this

Nineteenth Day of November, 2002

*Attest:*

*Attesting Officer*

JAMES E. ROGAN
*Director of the United States Patent and Trademark Office*